US006641464B1

(12) United States Patent
Steere, III

(10) Patent No.: US 6,641,464 B1
(45) Date of Patent: Nov. 4, 2003

(54) METHOD AND APPARATUS FOR POLISHING THE EDGE OF A BONDED WAFER

(75) Inventor: Robert E. Steere, III, Boonton, NJ (US)

(73) Assignee: Accretech USA, Inc., Oakland, NJ (US)

( * ) Notice: Subject to any disclaimer, the term of this patent is extended or adjusted under 35 U.S.C. 154(b) by 0 days.

(21) Appl. No.: 10/371,716

(22) Filed: Feb. 21, 2003

(51) Int. Cl.[7] ..... B24B 1/00

(52) U.S. Cl. ..... 451/41; 451/287; 451/296; 451/303; 451/304; 451/311; 451/306

(58) Field of Search ..... 451/41, 287, 296, 451/303, 304, 306, 311

(56) References Cited

U.S. PATENT DOCUMENTS 6,306,016 B1 * 10/2001 Steere, Jr. et al. ..... 451/44

* cited by examiner

*Primary Examiner*—Joseph J. Hail, III
*Assistant Examiner*—Shantese McDonald
(74) *Attorney, Agent, or Firm*—Francis C. Hand; Carella, Byrne, Bain et al.

(57) ABSTRACT

A polishing bar is provided with a plurality of backings that are carried via blocks of impact absorbent material on a bar of greater stiffness. Each backing is shaped with two surfaces at an angle to each other. A polishing tape is disposed over the angled surfaces of each backing. The portion of the polishing tape over the forward surface of the backing is employed to polish the angled edge of the top wafer of a rotating bonded wafer pair.

16 Claims, 6 Drawing Sheets

METHOD AND APPARATUS FOR POLISHING THE EDGE OF A BONDED WAFER

This invention relates to a method and apparatus for polishing the edge of a bonded wafer. More particularly, this invention relates to a method and apparatus for polishing the edge of a bonded wafer after reducing the diameter of the top wafer.

As is known, wafers for the semiconductor industry have been bonded together by a bonding layer in a sandwich type relation for various applications. Further, for these applications, the top wafer diameter needs to be reduced while the diameter of the bottom or handling wafer remains unchanged.

In cases where the bonding layer does not extend to the outer diameter, the top wafer is thinned down to microns of thickness and the unsupported area beyond the bonding layer becomes problematic. The thinning process tends to chip the unsupported wafer edge and the debris created causes scratching and subsurface damage on the prime surface of the wafer. A more extreme example of the damage is that large pieces of the top wafer break off with the bonding layer attached.

A partial solution to this problem is to reduce the diameter of the top wafer by using a fixed abrasive grind wheel on a conventional edge grinder. Such applications are currently performed by companies producing SOI wafers (silicon on insulator) and result in a ledge being formed along the periphery of the handling wafer while the diameter of the upper wafer is reduced. Typically, the depth of sub-surface damage in the upper wafer created by conventional rough and fine grinding is on the order of 10 um deep.

It is an object of the invention to produce a high quality edge finish on reworked edges of bonded wafers.

It is another object of the invention to minimize subsurface damage in the processing of bonded wafers.

It is another object of the invention to improve the process yield of bonded wafers.

It is another object of the invention to reduce the depth of edge damage in a processed upper wafer of a pair of bonded wafers to levels below 1 um.

Briefly, the invention provides an apparatus for polishing a bonded wafer that includes a support; a body of impact absorbent material mounted on the support; and a backing mounted on the body and having two surfaces disposed at an angle to each other and on an opposite side of the backing from the body and the support. In addition, the apparatus includes means for positioning a polishing tape on the surfaces of the backing whereby a first forward surface is positioned for polishing a peripheral edge of a top wafer of a pair of bonded wafers. Typically, this means is able to move the polishing tape relative to and along the two surfaces of the backing to present fresh polishing media, for example, in a manner as described in pending U.S. patent application Ser. No. 09/740,154 filed Dec. 19, 2000.

In a case where the bonded wafers are disposed on a horizontal plane, the apparatus positions the second or trailing surface of the backing at an acute angle relative to a horizontal plane, for example, in the range of from 3° to 45°.

The apparatus also includes means for directing a coolant into an area under the polishing tape between the two angled surfaces of the backing for removing debris from between the bonded wafers and the tape.

The apparatus also includes means for oscillating the backing and tape thereon in at least one of a vertical plane and a horizontal plane during polishing of the top wafer or polishing of the edge of the handling wafer as well as means for moving the backing in a plane to allow the polishing tape on the trailing surface of the backing to polish a ledge on the handling wafer.

The invention also provides a method of polishing a bonded wafer including a handling wafer and a top wafer bonded to the handling wafer, the top wafer having a lesser diameter than the handling wafer and the handling wafer having an exposed ledge extending beyond the top wafer.

In accordance with the method, the pair of bonded wafers is rotated about an axis perpendicular to the top wafer while a backing having two surfaces disposed at an angle to each other is positioned with the forward surface opposite a peripheral edge of the rotating top wafer. In addition, a polishing tape is positioned on the forward surface of the backing in facing relation to the peripheral edge of the top wafer and the top wafer and backing are moved relative to each other to bring the polishing tape into polishing contact with the peripheral edge of the rotating top wafer.

In addition, during polishing, a coolant is directed into an area under the polishing tape between the two surface of the backing for removing debris.

The apparatus may also be employed to remove the bonding layer between the top wafer and the handling wafer. To this end, the polishing tape between the two angular surfaces of the backing are brought into contact with the bonding layer between the top wafer and the handling wafer to remove portions of the bonding layer therebetween. This step may be performed when only a portion of the peripheral edge of the top wafer is polished, e.g. in the vicinity of the bonding layer, or when the entire peripheral edge is polished.

The apparatus may also be employed during a polishing operation to polish the ledge on the handling wafer. To this end, the handling wafer and backing are moved relative to each other to have the polishing tape between the forward surface and the trailing surface of the backing polish the ledge as the handling wafer and backing are being moved relatively away from each other.

The apparatus and method provides a high quality edge that minimizes subsurface damage. This, in turn, improves the process yield and quality of a subsequent thinning process that reduces the top wafer to microns of thickness.

These and other objects and advantages will become more apparent from the following detailed description taken in conjunction with the accompanying drawings wherein.

Figure 1:
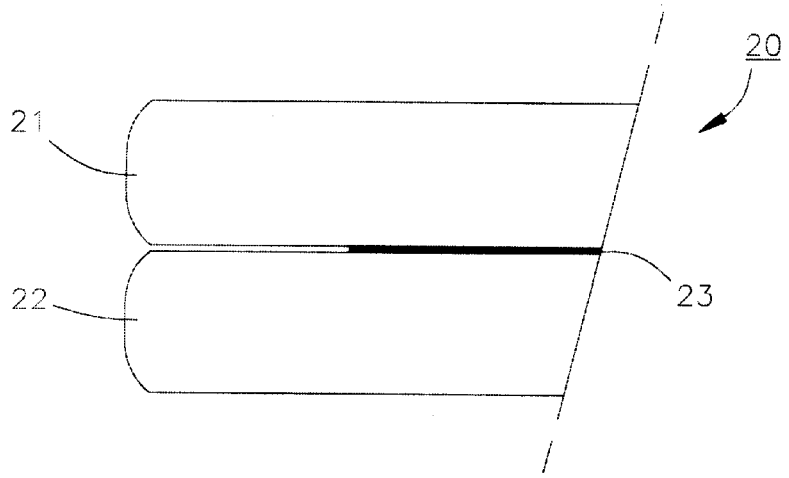
FIG. 1 illustrates a pat cross-sectional view of a conventional pair of bonded wafers.

Referring to FIG. 1, a conventional bonded pair of wafers 20 includes a top wafer 21, a handling wafer 22 and a bonding layer 23 of conventional material. As illustrated, the bonding layer 23 does not extend to the outer diameters of the wafers.

Figure 2:
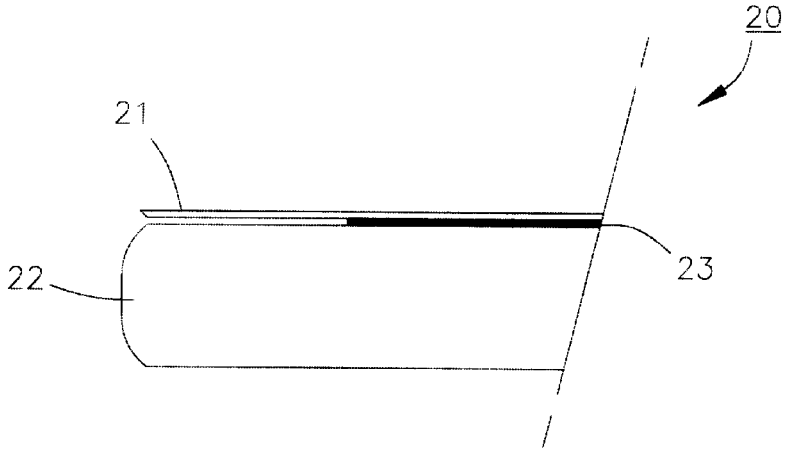
FIG. 2 illustrates the bonded wafers of FIG. 1 after processing to produce a thinned top wafer.

Referring to FIG. 2, wherein like reference characters indicate like parts as above, after the bonded pair of wafers 20 has been fully processed, the top wafer 21 is thinned to a minor fraction of its original thickness.

Figure 3:
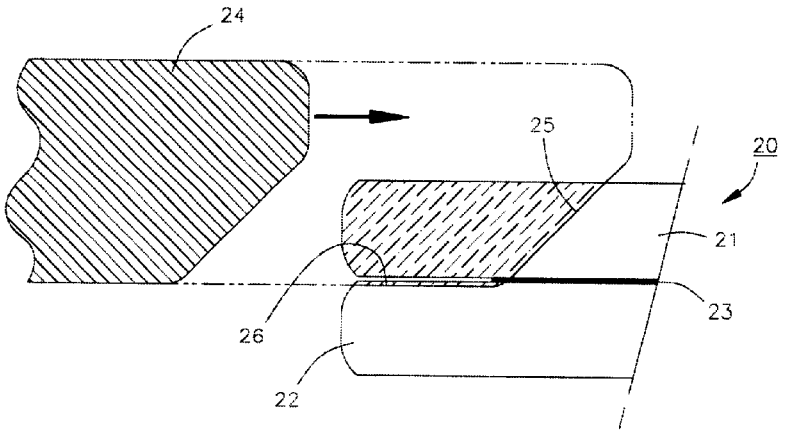
FIG. 3 illustrates the use of a rotating grind wheel in a conventional process for removing material from the top wafer of the bonded wafer of FIG.1 while forming a ledge on the handling wafer.

Referring to FIG. 3, wherein like reference characters indicate like parts as above, during a conventional process, a rotating grind wheel 24 moves linearly into the rotating wafer pair, removing enough material from the top wafer 21 to reach the bonding layer 23 while reducing the diameter of the top wafer 21 and cutting the wafer 21 on an angle A to form an angled surface 25.

At the same time, the grind wheel 24 forms a ledge 26 along the periphery of the handling wafer 22. The length of the ledge 26 and the angle A of the surface cut into the top wafer 21 may vary based on customer processes.

Figure 4:
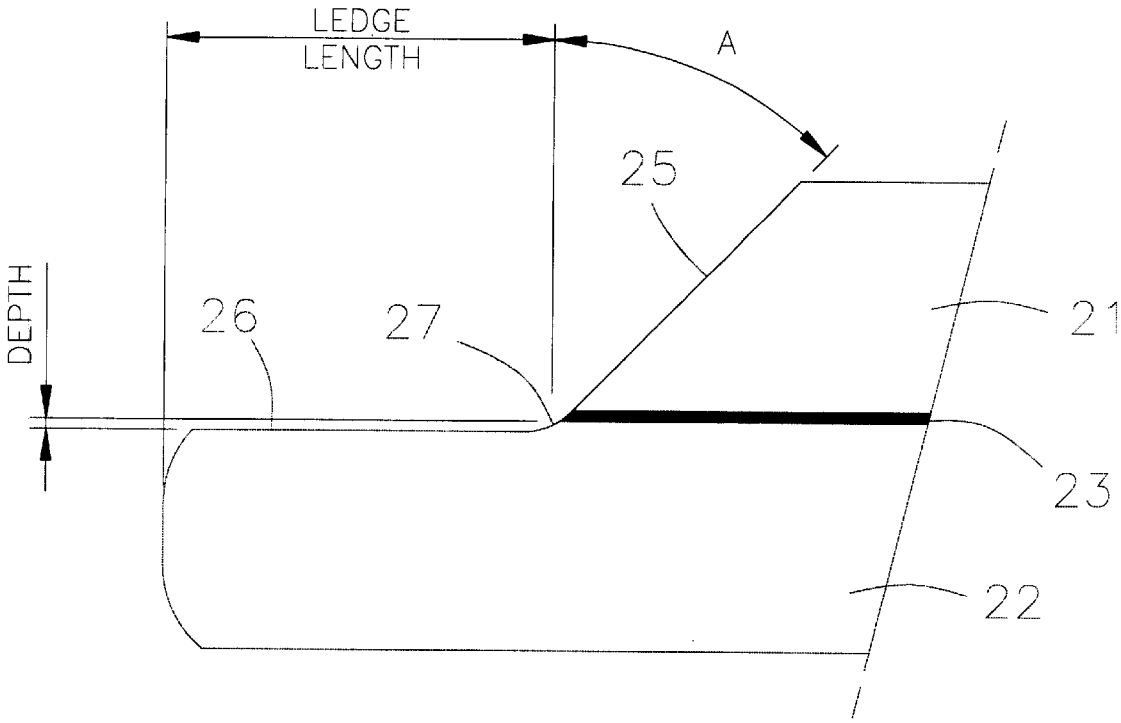
FIG. 4 illustrates a cross-sectional view of a processed bonded pair of wafers showing relative relationships of the various surfaces.

Referring to the FIG. 4, the angle A may vary from 0° to 80°, and the length of the ledge 26 typically will be less then 8 mm, but is not limited to this value. The radius 27 that blends the ledge 26 and the angled surface 25 is typically kept to a minimum. A large radius 27 will create a sharper knife-edge along the bottom edge of the top wafer 21 and be more susceptible to chipping. Customers would also like to minimize the depth of the ledge 26 cut into the handling wafer 22.

Chipping plays a major role in the quality produced by a subsequent top wafer thinning process. Particles or chips generated during the thinning process have the, potential of being carried over the prime surface of the wafer and causing damage proportional to their size. Therefore, minimizing the depth of damage on the edge of the wafer 21 will minimize the size of chips produced, and improve the quality of the thinning process.

Figure 5:
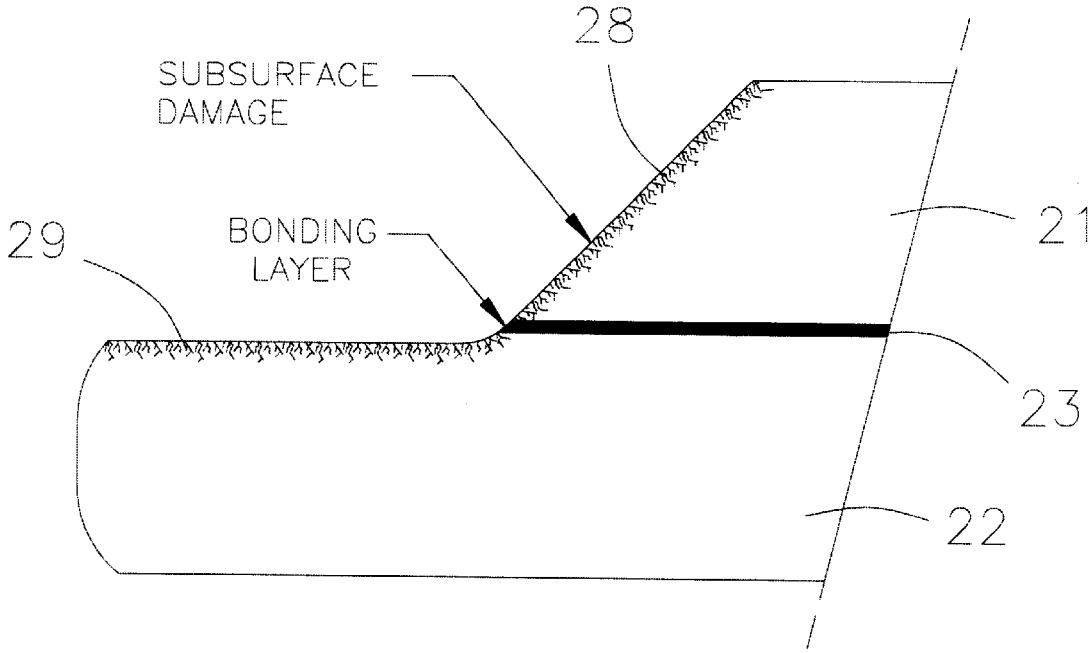
FIG. 5 illustrates a view similar to FIG. 4 of the surfaces of the profile where subsurface damage is created by conventional grinding.

FIG. 5, wherein like reference characters indicate like parts as above, illustrates the surfaces 28, 29 of the profile where subsurface damage is created by conventional grinding, namely the peripheral surface 28 of the top wafer 21 and the ledge surface 29 of the handling wafer 23.

The apparatus for polishing a bonded wafer pair 20 is constructed in a manner as described in pending U.S. patent application Ser. No. 09/740,154 filed Dec. 19, 2000 and the disclosure thereof is incorporated by reference herein.

Figure 6:
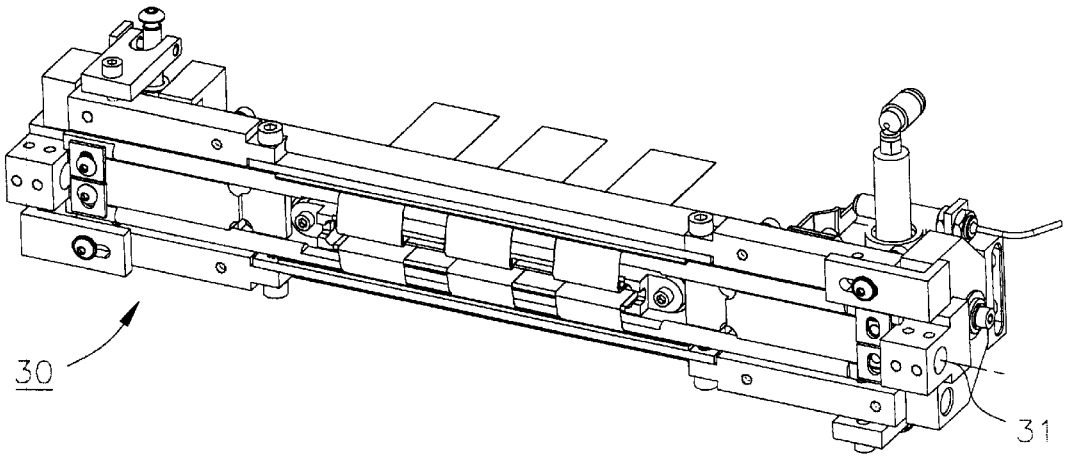
FIG. 6 illustrates a perspective view of a polishing machine employing an apparatus in accordance with the invention.
Figure 7:
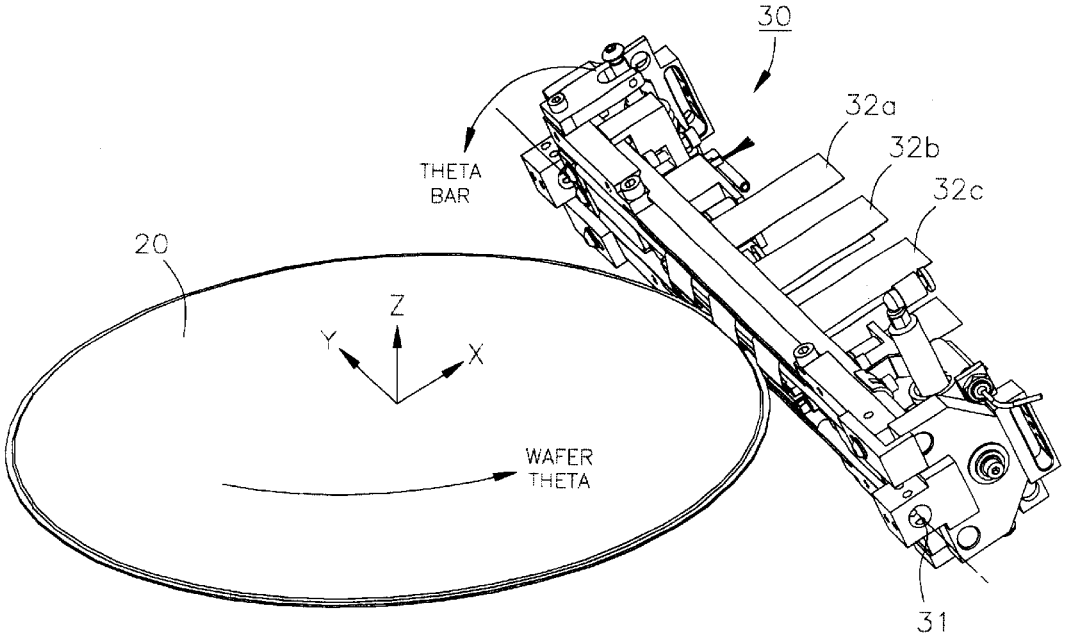
FIG. 7 illustrates a view of the apparatus of FIG. 6 during polishing of the edge of the top wafer of a bonded wafer in accordance with the invention.

As illustrated in FIGS. 6 and 7, the apparatus includes a polishing bar 30 that is pivotally mounted via an axle 31 to pivot about a horizontal axis so as to move from one side of the bonded wafer pair 20 to the other side. The polishing bar 30 includes a clamp assembly for holding a plurality of polishing tapes 32*a*,32*b*,32*c*, each of which may have a different grade of polishing media thereon from the other, such as, coarse, medium and fine. These tapes 32*a*,32*b*,32*c* are fed to the polishing bar 30 and returned from the polishing bar 30 as described in the co-pending application noted above so that no further description is believed to be necessary in this regard.

The apparatus also has means (not shown) for oscillating the polishing bar 30 about the axle 31 in a vertical plane when the axle is in a horizontal plane.

Figure 8:
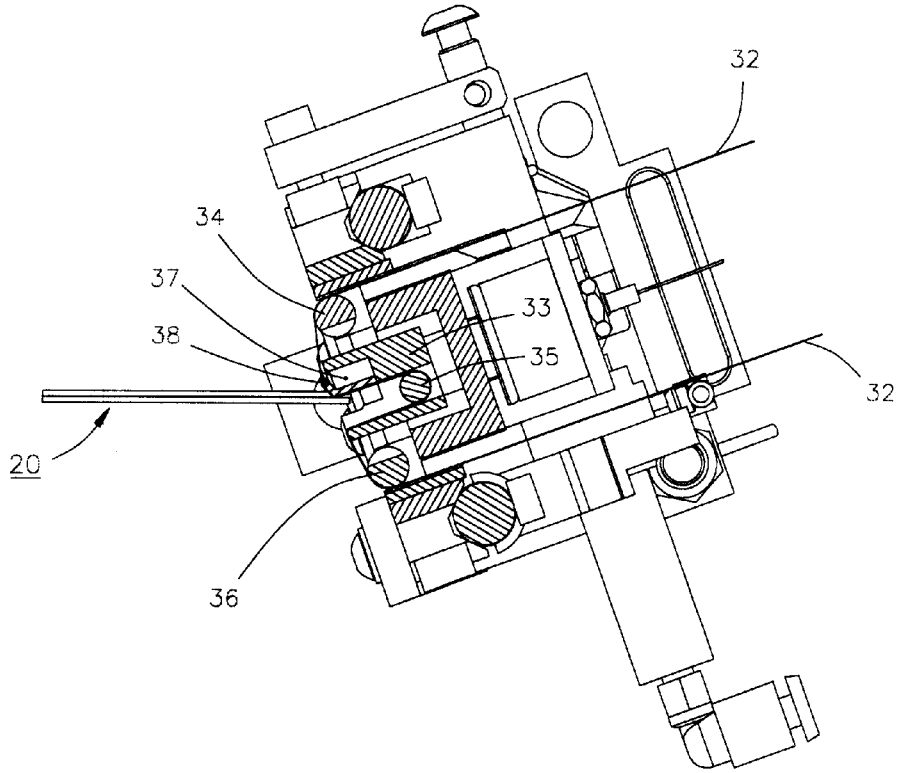
FIG. 8 illustrates a cross-sectional view of the apparatus of FIG. 6.
Figure 9:
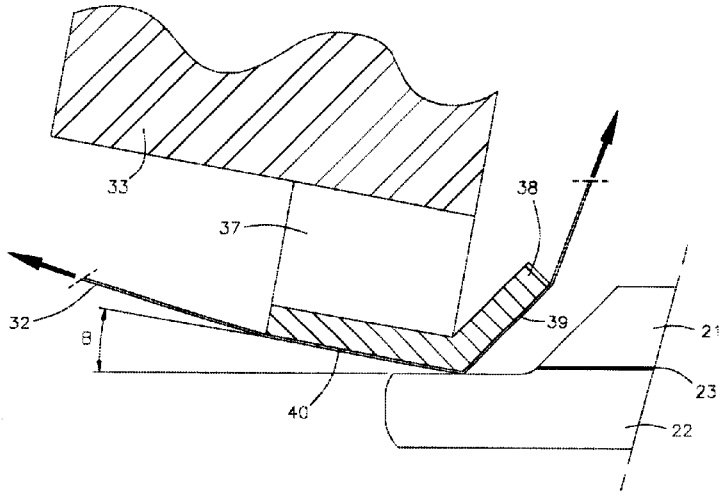
FIG. 9 illustrates a cross-sectional view of an apparatus in accordance with the invention at the start of a polishing operation.

Referring to FIGS. 8 and 9, the polishing bar 30 includes a support 33 of rigid construction that is in the form of a bar fixedly mounted in place in the polishing bar 30 and extending longitudinally of the tapes 32. As indicated in FIG. 8, the support 33 is located in parallel to deflection rolls 34, 35, 36 over which the tapes 32 are guided.

The support 33 carries a plurality of bodies 37 of impact absorbent material, such as foam rubber or polyvinyl alcohol sponge, of lower stiffness than the support 33, each located behind a respective tape 32. Each body 37 is affixed directly to the support 33 as by adhesive or other suitable means. In addition, each body 37, in turn, has a rigid backing 38 secured thereon on a side opposite the support 33. The rigid backing 38 is made out of a material, such as Deirin®.

As shown in FIG. 9, each backing 38 has a pair of surfaces 39, 40 that are disposed at an angle relative to each other and over which a respective tape 32 is mounted. For example, the two surfaces are disposed to define an included angle C (FIG. 10) of from 60° to 160°. The first or forward surface 39 of the backing 38 is to be disposed in facing relation to the angled surface 25 of the top wafer 21 while the second or trailing surface 40 is disposed at an acute angle β relative to a horizontal plane.

Referring to FIG. 7, during operation, the bonded wafer pair 20 after being processed into a state as shown in FIG. 4, is mounted on a suitable chuck and rotated about an axis perpendicular to the plane of the wafer pair 20. Typically, the wafer pair 20 is rotated about a vertical axis. Thereafter, the wafer pair 20 is moved toward the polishing bar 30. The wafer pair 20 can be processed with one tape 32 or stepped through multiple tapes 32 of decreasing abrasive size for higher levels of surface finish and lower subsurface damage.

Each tape 32 is clamped in light tension against the two surfaces 39, 40 of the backing 28.

As the process proceeds, the wafer pair 20 begins rotating and coolant is applied before moving the wafer pair into contact with the tape 32.

Figure 10:
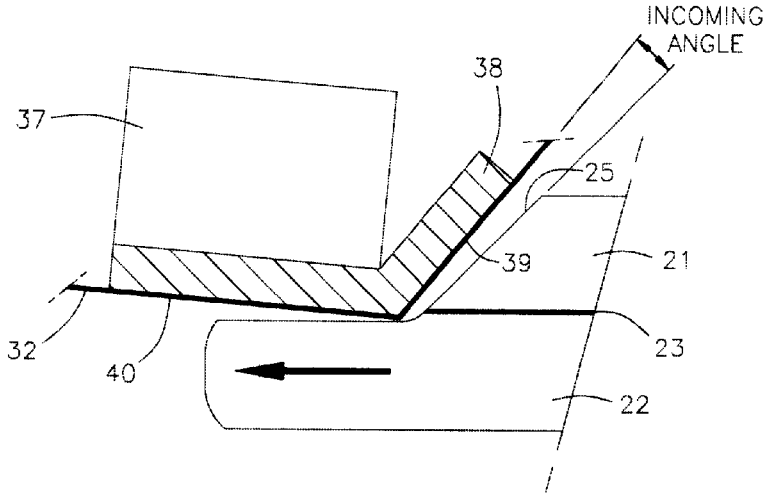
FIG. 10 illustrates a view similar to FIG. 9 of the apparatus approaching the peripheral edge of the top wafer.
Figure 11:
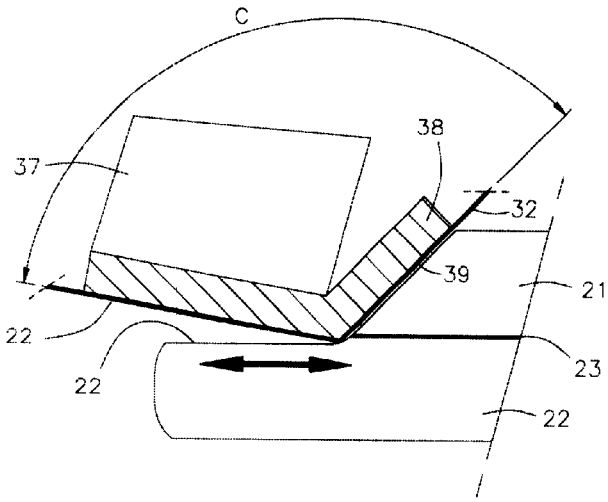
FIG. 11 illustrates a view similar to FIG. 9 of the apparatus during polishing of the peripheral edge of the top wafer.

The wafer pair 20 is then fed into the polishing bar 30 using a linear X motion as indicated in FIG. 10. Alternatively, the wafer pair 20 could be brought into contact using a Z motion or combination of X and Z motions.

Once the wafer pair 20 reaches the polishing tape 32 on the forward surface 39 of the backing 38 polishing of the angled surface 25 of the wafer profile, the backing 38 is caused to pivot clockwise, as viewed, so as to move the tape 32 on the forward face 39 of the backing 38 against the angled surface 25. Polishing then begins in a programmed manner. X and Y oscillatory motions are used during this operation for improved surface quality. During this time, the tape 32 on the trailing surface 40 of the backing 38 is spaced from the ledge 26 of the handling wafer 22.

As the bonding layer 23 is reached, the tape 32 on the forward surface 39 of the backing 38 and at the juncture of the two surfaces 39, 40 removes material from the bonding layer 23.

After a programmed polishing operation is completed, the wafer pair 20 moves out from under the polishing bar 30 in a controlled X linear motion at a specified speed. The wafer may also be oscillated in a Y direction at the same time. During this time, the tape 32 lying over the point of juncture of the surfaces 39, 40 polishes the ledge 26 of the handling wafer while the trailing surface 40 remains at a small angle relative to the ledge 26 to provide sufficient space for debris and coolant to pass. Placing the lower backing surface 40 parallel and in contact with the ledge 26 would result in entrapped debris, poor coolant penetration, higher processing temperatures, and a breakdown of the abrasive layer on the tape 32.

Polishing of the ledge 26 on the handling wafer 22 may be omitted where desired.

Once the wafer pair 20 is clear, the polishing bar 30 rotates the support 33 to a lower position aligning the ledge 26 of the handling wafer with the forward surface 39 of the tape-backing. Moving the wafer pair 20 in the Z direction will also accomplish this.

The wafer pair 20 then moves into contact with the tape 32 and a chamfering step is performed using X and Y oscillatory motions for a specified period of time for improved surface quality. The corner could also be rounded using a more complex algorithm involving the rotary axis of the polishing bar 30.

The apparatus used in this invention is similar to the apparatus in U.S. patent application Ser. No. 09/740,154 in the following respects:

The wafer pair 20 to be processed is held by a rotary vacuum chuck, which is equipped with stages to move the wafer in the X, Y, and Z directions.

Multiple feed and take-up reels are present to increment abrasive tapes between wafers.

Abrasive tapes are routed through a main polishing bar 30. The bar can rotate as described in patent application Ser. No. 09/740,154, although it is not necessary.

The main polishing bar 30 uses the same mechanism to clamp the abrasive tapes 32 during processing, and also the same force detection mechanism to determine the proper engagement of the top wafer 21 into the abrasive tape 32.

The tape backing 38 is shaped to allow a tape 32 to polish the ledge 26, the angled surface 25 of the top wafer, and the bonding layer 23 in the comer of the profile without the use of complex motion algorithms.

When the angled surface 25 of the top wafer 21 is being polished by the tape 32, the front surface 39 of the backing 38 is positioned at a small angle relative to the angled surface 39. As the bottom of the angled surface 25 contacts the tape 32, the impact absorbent material 37 begins to deform allowing the tape backing 38 to pivot into contact with the angled surface 25.

In the forward position, the line of contact between the tape on the forward surface 39 of the backing 38 and the angled surface 25 of the top wafer 21 restricts the effectiveness of the coolant. Therefore, the wafer pair 20 is oscillated back and forth in the X-direction to allow coolant to flush debris and maintain an acceptable process temperature. Thus, preventing damage to the abrasive matrix on the tape. The wafer pair 20 can also move back and forth in the Y-direction to expose more abrasive area to the wafer.

Figure 12:
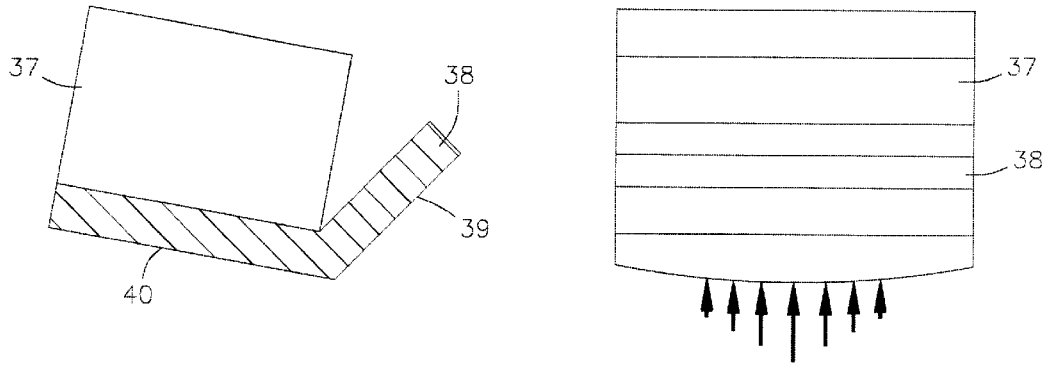
FIG. 12 illustrates a front view of a curved backing in accordance with the invention.
Figure 13:
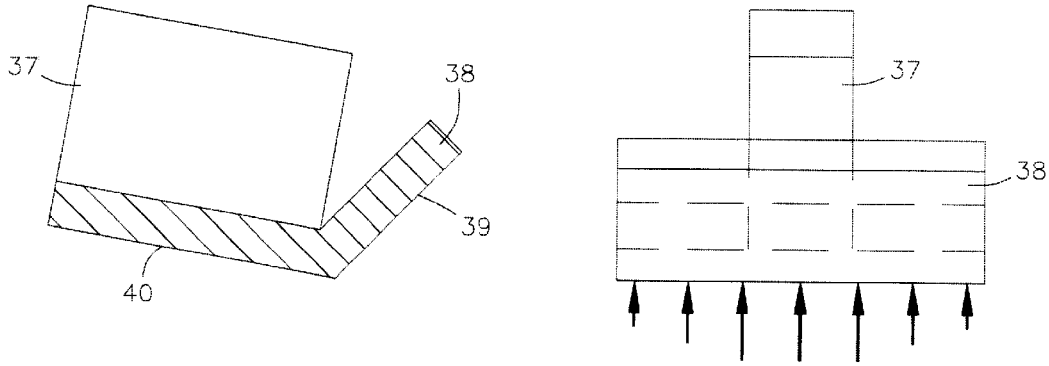
FIG. 13 illustrates a schematic view of the forces applied to a planar backing in accordance with the invention.

The lower backing surface 40 can be slightly convex as indicated in FIG. 12 or planar as indicated in FIG. 13. A slightly convex shape is preferable, because such a surface concentrates a higher cutting force at the apex of the surface. FIG. 12 illustrates a tape backing 38 supported over its full length by the impact absorbent material 37. The convex shape is machined into the backing 38. FIG. 13 illustrates a backing 38 with planer surfaces supported at the center by the impact absorbent material 37. The unsupported areas of the backing 38 deflect upward due to the initial tape tension, and the force created against the wafer pair during processing. In both embodiments, the abrasive cutting force can be concentrated into the corner at the bottom of the angled surface 25 of the top wafer 21 to polish the bonded layer interface 23.

In some cases, a 0° angle cut may be deisred. In this case, the surface 25 of the top wafer is perpendicular to the handling wafer 21. A backing 38 having appropriately angled surfaces 39,40 is thus used to accomodate polishing of the surface at that angle.

The invention thus provides a technique for producing a high quality edge finish on reworked edges of bonded wafers. Further, the invention provides an apparatus and method of processing bonded wafers that minimizes subsurface damage in the processing of bonded wafers to levels below 1 um.

The invention also provides an apparatus and method of processing bonded wafers that is able to improve the process yield of bonded wafers.

What is claimed is:

1. An apparatus for polishing a bonded wafer, said apparatus comprising a support;

a body of impact absorbent material mounted on said support;

a backing mounted on said body and having a first surface and a second surface disposed at an angle to said first surface, said first and second surfaces being disposed on an opposite side of said backing from said body and said support; and means for positioning a polishing tape on said first surface and said second surface of said backing whereby said first surface is positioned for polishing a peripheral edge of a top wafer of a pair of bonded wafers.

2. An apparatus as set forth in claim 1 wherein said second surface of said backing is disposed at an acute angle relative to a horizontal plane of from 3° to 45°.

3. An apparatus as set forth in claim 2 wherein said first surface and said second surface of said backing define an included angle of from 60° to 160°.

4. An apparatus as set forth in claim 1 wherein said body is made of one of foamed rubber and polyvinyl alcohol sponge.

5. In combination a support;

a body of impact absorbent material mounted on said support;

a backing mounted on said body and having a pair of surfaces disposed at an angle to each other and disposed on an opposite side of said backing from said body and said support; and a polishing tape on said surfaces of said backing for positioning of a portion of said tape on a forward surface of said surfaces against a peripheral edge of a top wafer of a pair of bonded wafers.

6. The combination as set forth in claim 5 wherein said backing is pivotable relative to said support under a force imposed on said forward surface during contact of said portion of said tape against a peripheral edge of a top wafer of a pair of bonded wafers.

7. The combination as set forth in claim 5 wherein said surfaces of said backing define an included angle of from 60° to 160°.

8. A method of polishing a bonded wafer, said method comprising the steps of rotating a pair of bonded wafers including a handling wafer and a top wafer bonded to the handling wafer about an axis perpendicular to the top wafer, the top wafer having a lesser diameter than the handling wafer and the handling wafer having an exposed ledge extending beyond the top wafer;

positioning a backing having a first surface and a second surface disposed at an angle to said first surface opposite a peripheral edge of the top wafer;

positioning a polishing tape on the first surface of the backing in facing relation to the peripheral edge of the top wafer; and moving the top wafer and backing relative to each other perpendicularly of said axis to bring the polishing tape into polishing contact with the peripheral edge of the rotating top wafer.

9. A method as set forth in claim 8 wherein the second surface of the backing is spaced from the ledge of the handling wafer during polishing of the peripheral edge of the top wafer.

10. A method as set forth in claim 8 further comprising the step of directing a coolant into an area between the first surface and the second surface of the backing for removing debris therefrom.

11. A method as set forth in claim 8 further comprising the step of bringing the polishing tape between the first and second surfaces of the backing into contact with a bonding layer between the top wafer and the handling wafer to remove portions of the bonding layer therebetween.

12. A method as set forth in claim 8 further comprising the step of moving the handling wafer and backing relative to each other to have the polishing tape at the juncture between the first surface and the second surface of the backing polish the ledge on the handling wafer.

13. A method as set forth in claim 8 further comprising the step of oscillating the backing in at least one of a vertical plane and a horizontal plane during polishing of the top wafer.

14. A method as set forth in claim 8 further comprising the step of moving the handling wafer and backing relative to each other to have the polishing tape on the first surface of the backing polish a periphery edge of the handling wafer after polishing of the peripheral edge of the top wafer.

15. A method as set forth in claim 8 further comprising the step of oscillating the backing in at least one of a vertical plane and a horizontal plane during polishing of the edge of the handling wafer.

16. A method of processing a bonded wafer, said method comprising the steps of rotating a pair of bonded wafers including a handling wafer, a top wafer and a bonding layer bonding the top wafer to the handling wafer about an axis perpendicular to the top wafer, the top wafer having a lesser diameter than the handling wafer, the handling wafer having an exposed ledge extending beyond the top wafer and the bonding layer having an exposed periphersl edge;

positioning a backing having a first surface and a second surface disposed at an angle to said first surface opposite a peripheral edge of the top wafer;

positioning a polishing tape on the first surface of the backing in facing relation to the peripheral edge of the top wafer; and moving the top wafer and backing relative to each other perpendicularly of said axis to bring the polishing tape at the juncture of the first surface and second surface of the backing into contact with the peripheral edge of the bonding layer.

* * * * *

UNITED STATES PATENT AND TRADEMARK OFFICE

CERTIFICATE OF CORRECTION

PATENT NO. : 6,641,464 B1
DATED : November 4, 2003
INVENTOR(S) : Robert E. Steere, III It is certified that error appears in the above-identified patent and that said Letters Patent is hereby corrected as shown below:

Column 2,
Line 48, change “pat” to -- part --

Column 4,
Lines 52-53, “polishing of the. . .wafer profile” should be cancelled

Signed and Sealed this

Twenty-third Day of December, 2003

JAMES E. ROGAN
*Director of the United States Patent and Trademark Office*